US009079250B2

(12) United States Patent
Feng et al.

(10) Patent No.: US 9,079,250 B2
(45) Date of Patent: Jul. 14, 2015

(54) METHOD OF PREPARING SILVER NANOWIRE

(71) Applicant: NICHING INDUSTRIAL CORPORATION, Hsinchu County (TW)

(72) Inventors: Hsiang-An Feng, Hsinchu (TW); Chung-Hung Chang, Taipei (TW); Hsin-Fang Chang, Hsinchu County (TW); Pei-Chen Huang, Hsinchu (TW)

(73) Assignee: NICHING INDUSTRIAL CORPORATION, Chupei (TW)

( * ) Notice: Subject to any disclaimer, the term of this patent is extended or adjusted under 35 U.S.C. 154(b) by 310 days.

(21) Appl. No.: 13/763,043

(22) Filed: Feb. 8, 2013

(65) Prior Publication Data

US 2014/0102255 A1 Apr. 17, 2014

(30) Foreign Application Priority Data

Oct. 16, 2012 (TW) ..... 101138047 A

(51) Int. Cl.
*B22F 9/24* (2006.01)
*B22F 1/00* (2006.01)

(52) U.S. Cl.
CPC *B22F 9/24* (2013.01); *B22F 1/0025* (2013.01)

(58) Field of Classification Search
None
See application file for complete search history.

(56) References Cited

U.S. PATENT DOCUMENTS

| | | | | |
|---|---|---|---|---|
| 7,585,349 | B2 | 9/2009 | Xia et al. | |
| 7,922,787 | B2 | 4/2011 | Wang et al. | |
| 2008/0064767 | A1* | 3/2008 | Chou et al. | 516/97 |
| 2008/0210052 | A1* | 9/2008 | Allemand | 75/300 |
| 2010/0269635 | A1* | 10/2010 | Vanheusden et al. | 75/370 |
| 2012/0171499 | A1* | 7/2012 | Rouse | 428/457 |
| 2013/0160608 | A1* | 6/2013 | Nusko et al. | 75/370 |

FOREIGN PATENT DOCUMENTS

| | | | |
|---|---|---|---|
| DE | 10-2010-017706 | A1 * | 1/2012 |
| TW | 200742732 | A | 11/2007 |
| TW | I337892 | B | 3/2011 |

* cited by examiner

*Primary Examiner* — George Wyszomierski
(74) *Attorney, Agent, or Firm* — Kirton McConkie; Evan R. Witt

(57) ABSTRACT

The present invention is related to a method of preparing silver nanowire, wherein the method uses aldehyde derivatives as reducing agent to reduce silver salt with positive one valence of silver, to silver nanowire under the presence of organic accelerant. The preparation steps comprise: (A) providing a solution comprising an organic accelerant and an aldehyde derivative, heating the solution and then adding an acid into the solution to form a first solution; and (B) adding a silver salt solution with positive one valence of silver into the first solution to form silver nanowire.

11 Claims, 1 Drawing Sheet

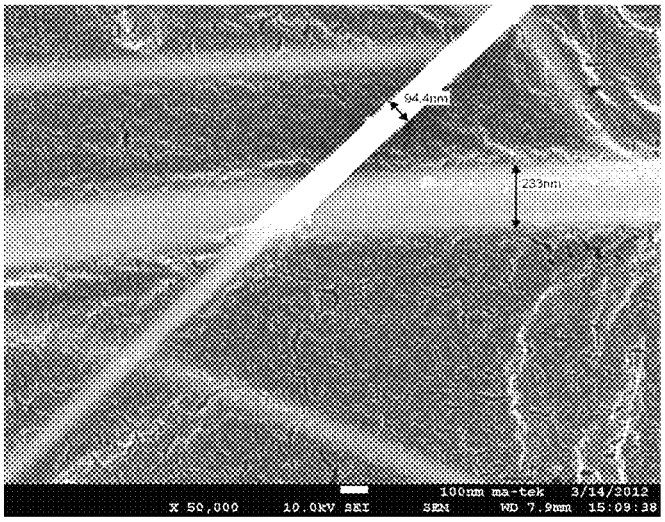
94.4nm
233nm
100nm ma-tek 3/14/2012
X 50,000 10.0kV SEI SEM WD 7.9mm 15:09:38

METHOD OF PREPARING SILVER NANOWIRE

BACKGROUND OF THE INVENTION

1. Field of the Invention

The present invention relates to a method of preparing silver nanowire, which more particularly relates to a method of using water as solvent, and aldehyde derivatives as reducing reagent to prepare silver nanowire.

2. Description of Related Art

Due to the dramatic increase of surface area made for nanoscale silver materials, the nanoscale silver material have special features, and is widely applied for various purposes, such as high conductivity nanosilver coating, nanosilver catalyst, and high antimicrobial nanosilver bactericide. For optoelectronic materials, transparent conductive films are indispensable materials of optoelectronic units. Most transparent conductive films for the optoelectronic products are made of indium tin oxide (ITO). However, consideration of the shortage of indium and flexible electronics applications in the future has called for increasing demand for many new conductive materials, such as carbon nanotubes, graphene, and metal nanowire. Wherein the recent method for preparing silver nanowire is template synthesis method, zero-dimension self-assembly method, photo-reduction method, thermal reduction method, solid-liquid interfacial reaction method, seed growth method, and polyol synthesis.

Recently, silver nanowire is mainly prepared by polyol synthesis, wherein a large amount of organic solvent is needed for the preparation process, and precious metal, such as palladium and platinum metal, is used as catalyst. In addition, the preparation process needs to take place at a high temperature (>160° C.), hence, this current method of preparing silver nanowire is not suitable for mass production, the cost is relatively expensive, and the method is not conductive to the mass production in the industry.

Therefore, a new method of preparing silver nanowire is needed to replace the previous preparation method, which uses organic solvent as reducing reagent and precious metal as catalyst, in order to lower the preparation cost, to meet the environmental requirements, and be conductive to mass production.

SUMMARY OF THE INVENTION

The object of the present invention is to provide a method of preparing silver nanowire, which uses aldehyde derivatives as a reducing reagent to reduce silver salt with one positive valence into silver nanowire in presence of an organic accelerant. The steps are composed of (A) providing a solution containing an organic accelerant and an aldehyde derivative, heating the solution and then adding an acid into the solution to react and form a first solution; and (B) adding a silver salt solution with a positive one valence of silver into the first solution to form silver nanowire.

According to the method of preparing silver nanowire described above, in step (A), the organic accelerant is polyvinylpyrrolidone (PVP), and the molecular weight of polyvinylpyrrolidone is between 20,000 and 50,000. The concentration of the organic accelerant is between 0.05 M and 1 M, which is preferred to be between 0.1 M and 0.5 M. The aldehyde derivatives used in step (A) is preferred to be a $C_1$~$C_{10}$ aldehyde, such as formaldehyde, acetaldehyde, furfural, and 3,4,5-methoxybenzaldehyde. The concentration of the aldehyde derivatives is between 0.01 M and 1 M, and between 0.03 M and 0.07 M is preferred, wherein between 0.05 M and 0.07 M is more preferable. The acid used in step (A) is selected from the group consisting of nitric acid, hydrochloric acid, and sulfuric acid, and the concentration of the acid is between 0.001 M and 0.01 M, wherein a range between 0.002 M and 0.007 M is preferred, wherein a range between 0.003 M and 0.005 M is more preferable. In addition, in step (A), the solution is heated to a temperature in the range of 70° C.~120° C., wherein the range of 80° C.~100° C. is preferred, and the reaction time is 1~10 minutes, wherein 1~5 minutes is preferred.

According to the method of preparing silver nanowire described above, wherein in step (B), the silver salt solution with a positive one valence of silver is silver nitrate solution. The reaction time in step (B) is 1~6 hours, wherein is preferred to be 2~5 hours.

The method of preparing silver nanowire of the present invention uses water as a solvent, hence the preparing process is more environmental friendly than the methods in the known art. Further, the method of the present invention has the advantages of short reaction time and low reaction temperature, which is suitable for mass production and is relatively environmental friendly.

BRIEF DESCRIPTION OF THE DRAWINGS

FIG. 1 is an image of a silver nanowire prepared by embodiment 1.

DETAILED DESCRIPTION OF THE PREFERRED EMBODIMENT

<Embodiment 1>

A mixture of 27 g of PVP with molecular weight of approximately 30000 and 148 g of water is added into a three-neck bottle, mixed well and heated to 85° C. 0.3 g of paraformaldehyde is then added to the mixture and 0.1 mL of nitric acid is slowly added to react for 3 minutes. After the above reaction, 46 mL of silver nitrate solution (1.6 M) is slowly added into the three-neck bottle and react at 85° C. for 5 hours. After cooling, sedimentation method is performed by adding ethanol or water to remove PVP in order to obtain the silver nanowire. The silver nanowire having a width of 94 to 223 nm and a length of 16 to 25 μm is observed by electron microscope. The morphology is shown in FIG. 1.

<Embodiment 2>

A mixture of 27.5 g of PVP with molecular weight of approximately 30000 and 148 g of water is added into a three-neck bottle, mixed well and heated to 85° C. 2.6 g of furfural is then added to the mixture and 0.1 mL of nitric acid is slowly added to react for 3 minutes. After the above reaction, 50 mL of silver nitrate solution (1.5 M) is slowly added into the three-neck bottle and react at 85° C. for 5 hours. After cooling, sedimentation method is performed by adding ethanol or water to remove PVP in order to obtain the silver nanowire. The silver nanowire having a width of 240 to 360 nm and a length of 6 to 12 μm is observed by electron microscope.

<Embodiment 3>

A mixture of 28 g of PVP with molecular weight of approximately 30000 and 150 g of water is added into a three-neck bottle, mixed well and heated to 85° C. 10 mL of pre-dissolved solution of 3,4,5-methoxybenzaldehyde (5.3 g) is then added to the mixture and 0.1 mL of nitric acid is slowly added to react for 3 minutes. After the above reaction, 50 mL of silver nitrate solution (1.5 M) is slowly added into the three-neck bottle and react for 3 hours. After cooling, sedimentation method is performed by adding ethanol or water to remove PVP in order to obtain the silver nanowire. The silver nanowire having a width of 150 to 300 nm and a length of 9 to 48 μm is observed by electron microscope.

The above embodiments are for the convenience of description and examples only, the scope of the present invention is not limited hereinafter.

What is claimed is:

1. A method of preparing silver nanowire, which comprises the steps of:

(A) providing a first solution which contains an organic accelerant and an aldehyde derivative, heating the first solution, and then adding an acid into the first solution to react and form a second solution, wherein the first solution is heated to a temperature ranging from 70° C. to 120° C.; and (B) adding a silver salt solution with a positive one valence of silver into the second solution to form silver nanowire, wherein the silver nanowire has a width of 126-260 nm and a length of 6-48 μm.

2. The method as claimed in claim 1, wherein in step (A), the organic accelerant is polyvinylpyrrolidone (PVP).

3. The method as claimed in claim 2, wherein in step (A), a molecular weight of polyvinylpyrrolidone is 20,000 to 50,000.

4. The method as claimed in claim 1, wherein in step (A), a concentration of the organic accelerant is 0.05 M to 1 M.

5. The method as claimed in claim 1, wherein in step (A), the aldehyde derivative is a C1~C10 aldehyde.

6. The method as claimed in claim 1, wherein in step (A), the aldehyde derivative is selected from the group consisting of formaldehyde, acetaldehyde, furfural, and 3,4,5-methoxybenzaldehyde.

7. The method as claimed in claim 1, wherein in step (A), a concentration of the aldehyde derivative is 0.01 M to 1 M.

8. The method as claimed in claim 1, wherein in step (A), the acid is selected from the group consisting of nitric acid, hydrochloric acid, and sulfuric acid.

9. The method as claimed in claim 1, wherein in step (A), a reaction time is 1 to 10 minutes.

10. The method as claimed in claim 1, wherein in step (B), the silver salt solution with a positive one valence of silver is silver nitrate solution.

11. The method as claimed in claim 1, wherein in step (B), a reaction time is 1 to 6 hours.

* * * * *